US007988408B2

(12) United States Patent
Northrup et al.

(10) Patent No.: US 7,988,408 B2
(45) Date of Patent: Aug. 2, 2011

(54) TWO-PIECE BEARING HOUSING FOR A CENTRIFUGAL PUMP

(75) Inventors: James Northrup, Draper, UT (US); Kenneth Sessum, Sr., South Jordan, UT (US)

(73) Assignee: Envirotech Pumpsystems, Inc., Salt Lake City, UT (US)

( * ) Notice: Subject to any disclaimer, the term of this patent is extended or adjusted under 35 U.S.C. 154(b) by 35 days.

(21) Appl. No.: 12/151,319

(22) Filed: May 5, 2008
(Under 37 CFR 1.47)

(65) Prior Publication Data

US 2009/0016657 A1 Jan. 15, 2009

Related U.S. Application Data

(60) Provisional application No. 60/927,594, filed on May 4, 2007.

(51) Int. Cl.
*F04D 29/00* (2006.01)

(52) U.S. Cl. ..... 415/118; 415/214.1

(58) Field of Classification Search ..... 415/214.1, 415/118

See application file for complete search history.

(56) References Cited

U.S. PATENT DOCUMENTS

| | | | | |
|---|---|---|---|---|
| 1,931,724 | A | 10/1933 | Fageol et al. | |
| 3,083,529 | A * | 4/1963 | Hemilton | 60/221 |
| 4,052,133 | A * | 10/1977 | Yeater | 415/200 |
| 5,055,000 | A | 10/1991 | Akhter | |
| 5,496,155 | A * | 3/1996 | Noah et al. | 417/310 |
| 5,632,608 | A | 5/1997 | Rockwood | |
| 6,158,958 | A * | 12/2000 | Heer | 415/200 |
| 6,599,091 | B2 * | 7/2003 | Nagle | 415/229 |
| 6,887,034 | B2 | 5/2005 | Mesiter et al. | |
| 6,919,023 | B2 * | 7/2005 | Merritt et al. | 210/209 |
| 7,001,159 | B2 | 2/2006 | Peterson, Jr. et al. | |

* cited by examiner

*Primary Examiner* — Edward Look
*Assistant Examiner* — Ryan H Ellis
(74) *Attorney, Agent, or Firm* — Morriss O'Bryant Compagni

(57) ABSTRACT

A two-piece bearing housing is provided for use in centrifugal pumps having or requiring multiple chambers for enclosing or confining bearings or seals, and/or providing lubricant or coolant to the bearings and seals of the pump, the two-piece housing providing several improvements including the ability to make the two pieces from different materials, the reduction in scrap castings due to imprecision achieved in the casting process and improved structures in the housing for monitoring the lubricant chambers in the housing.

2 Claims, 7 Drawing Sheets

TWO-PIECE BEARING HOUSING FOR A CENTRIFUGAL PUMP

CROSS-REFERENCE TO RELATED APPLICATION

This application is a non-provisional application claiming priority to provisional patent application Ser. No. 60/927,594 filed May 4, 2007.

BACKGROUND OF THE INVENTION

1. Field of the Invention

This invention relates generally to centrifugal pumps and relates specifically to a two-piece bearing housing for use in a centrifugal pump.

2. Description of Related Art

Centrifugal pumps generally comprise a pump casing in which an impeller is positioned to rotate for the processing of fluid material. The impeller, which is connected to a drive shaft, is part of a rotating assembly that further comprises the drive shaft, ball bearings, seals, a mechanical shaft seal and various associated hardware. The rotating assembly is bolted to the pump casing in a manner that facilitates removal of the rotating assembly for repair or replacement. Further, a bearing housing is provided to house the drive shaft, at least one set of bearings and associated seals that support and isolate the drive shaft.

A bearing housing may be comprised of two chambers, including the bearing oil chamber and the mechanical seal oil chamber. The bearing oil chamber houses bearings for the drive shaft and is separately provided with lubricating fluid for the bearings. The mechanical seal oil chamber is typically isolated from the bearing oil chamber and is provided with a separate source of lubrication to lubricate the lip seals and mechanical shaft seal about the impeller.

The bearing housing of conventional centrifugal pumps is made of a one piece casting. In certain types of bearing housings, the casting of the one-piece bearing housing is complicated by the existence of the separate bearing oil chamber and the mechanical seal oil chamber. That is, two sand cores are made corresponding to the two separate oil chambers. The two sand cores are then positioned in a larger mold corresponding to the outer housing. Molten metal is then poured into the mold and about the two sand cores to produce the casting of the bearing housing.

The manufacture of a one-piece bearing housing is made difficult by the exacting placement of the two sand cores in order to provide the separate oil chambers. Additionally, it is difficult to get the molten metal to flow into the inner walls of the mold to form the wall which separates the two chambers.

Moreover, a gas is produced by the sand core material during the casting process when the core material is contacted with the molten metal. If the gas cannot escape the mold, it forms undesirable porosities in the wall of the casting.

The porosities essentially represent leaks through the wall of the casting and can be from moderate to severe in the degree to which the porosities extend into or through the wall of the casting. The existence of the porosities result in a certain number of castings being unusable, which increases the scrap rate for the casting process. The overall cost of the castings is increased proportionally to the amount of scrap that is produced through bad castings.

A further problem encountered with the present one-piece casting of bearing housings is the fact that core sand is difficult to extract from the casting. Additionally, metal chips resulting from the machining of the casting are difficult to remove from the casting. Consequently, a great deal of time and cost is spent attempting to produce a casting that is free of residual sand and metal chips, and attempts to remove metal chips and sand from the casting may not be entirely successful.

An additional cost concern relating to conventional one-piece bearing housings is the fact that the bearing housing is made of, for example, stainless steel when the pump is going to be used for more corrosive slurry processing. As such, the bearing housing must be made entirely from stainless steel due to the casting process. Because of the unitary, or one piece casting, no cost benefit can be derived from making part of the bearing housing from another, less costly metal material.

Thus, it would be advantageous in the centrifugal pump industry to provide a bearing housing that is more easily produced and with more accuracy, thereby reducing the amount of scrap castings. It would also be advantageous to provide a bearing housing that can be made from different metals to reduce the overall cost of the casting process and thereby reduce the cost of the pump and its operation.

BRIEF SUMMARY OF THE INVENTION

In accordance with the present invention, a bearing housing for a centrifugal pump is formed in two-pieces, which facilitates the manufacture of the bearing housing, enables the bearing housing to be made of disparate types of materials and significantly reduces the amount of scrap castings. While the bearing housing of the present invention is described in terms of use in a self-priming pump, it is possible to adapt the two-piece bearing housing of the present invention for use in other types of centrifugal pumps that have multiple bearing housing and/or multiple lubricant chamber arrangements.

The two-piece bearing housing of the present invention may be particularly directed to those types of bearing housings where one portion of the housing contains the bearings for the drive shaft of the pump, and that portion is positioned, housed or nested within another portion of the bearing housing.

The two-piece bearing housing of the present invention provides many and significant advantages over known bearing housings having two chamber housings. Principally, the present invention enables the two housings to be molded separately, thereby eliminating the need for the exacting precision required in making castings of one-piece bearing housings. The two-piece construction further eliminates small openings in the housing where gases can form during the casting process which leads to undesirable porosities in the casting. The amount of scrap castings is reduced as a result.

The two-piece construction further allows the two pieces to be made of different materials, thereby reducing the overall cost of the bearing housing and pump. The two-piece construction also facilitates repair and replacement, with a concomitant savings in repair costs since only one piece of the housing may need to be repaired or replaced, rather than requiring replacement of the entire bearing housing.

The configuration of the two-piece bearing housing of the present invention provides improved features over the conventional one-piece bearing housing. Specifically, the windows provided in the bearing housing for viewing the lubricant chambers are positioned away from the centerline of the pump, thereby facilitating viewing of the lubricant levels in the chambers during operation of the pump. The atmospheric chamber port is also advantageously provided away from the centerline of the pump to facilitate the critical monitoring of leakage from the bearing housing.

These and other advantages of the bearing housing of the present invention will become apparent in the exemplar description provided further below, and in the drawings.

BRIEF DESCRIPTION OF THE SEVERAL VIEWS OF THE DRAWINGS

In the drawings, which currently illustrate the best mode for carrying out the invention.

DETAILED DESCRIPTION OF THE INVENTION

Figure 1:
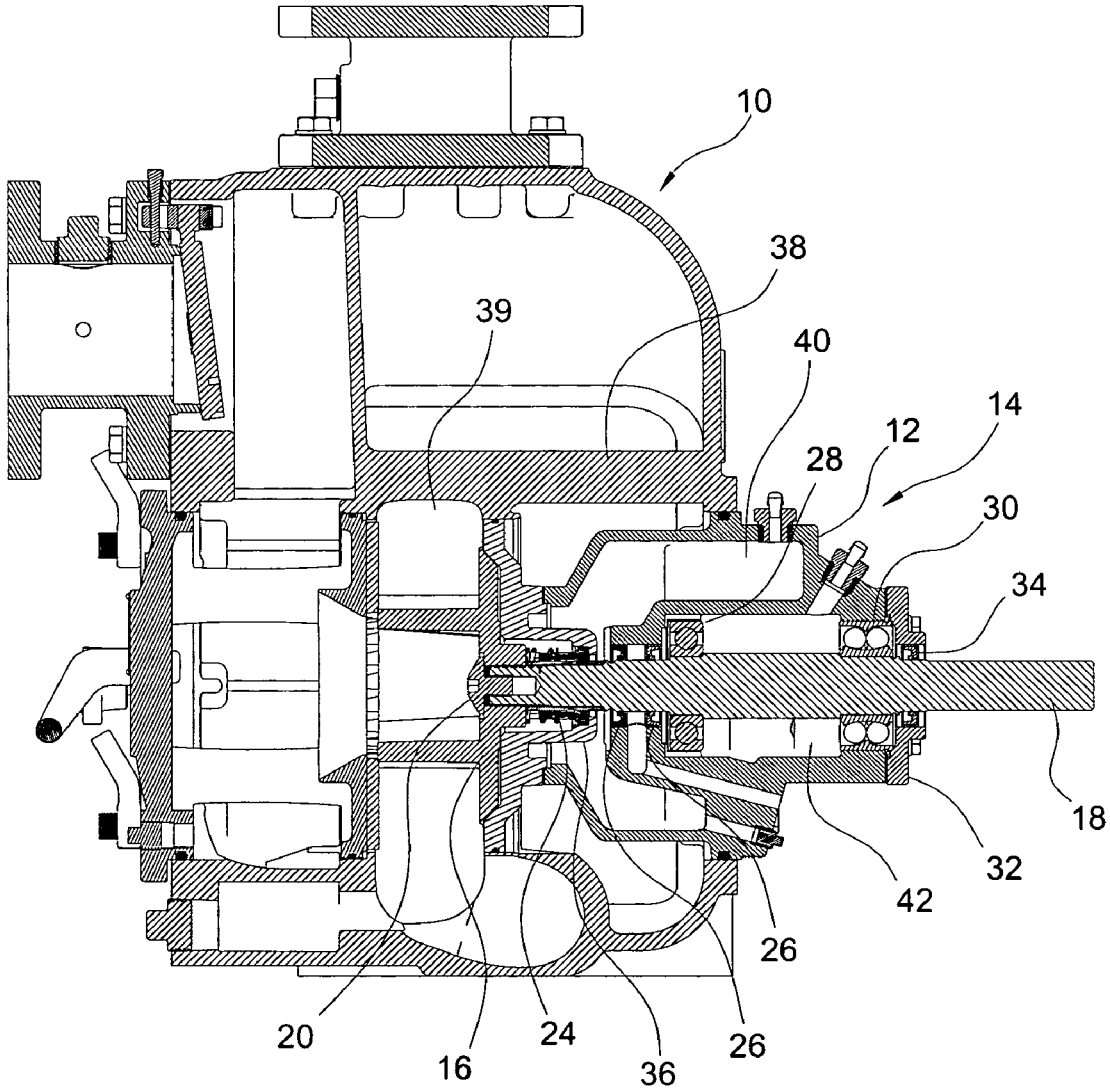
FIG 1. (PRIOR ART)
FIG. 1 is a view in cross section of a conventional self-priming pump illustrating a prior art bearing housing of one-piece construction, and its positioning within the pump.

FIG. 1 illustrates a self-priming centrifugal pump 10 of the prior art having a single-piece construction of the bearing housing 12. Self-priming pumps are well-known in the art and a description of the overall structure of the pump is not required here for the understanding of the present invention. The bearing housing 12 is part of the rotating assembly 14, which further comprises the impeller 16, the drive shaft 18 to which the impeller 16 is attached by an impeller bolt 20, a mechanical shaft seal 24, lip seals 26, forward bearing 28, rear bearing 30 and the bearing cap 32.

The impeller 16 is spaced from the bearing housing 12 by a seal plate 36 that is secured against the pump casing 38 and which provides a housing for the mechanical shaft seal 24. The mechanical shaft seal 24 surrounds the drive shaft 18 to seal against fluid leaks from the pump chamber 39. The lip seals 26 also surround the drive shaft 18 and seal the bearings 28, 30 housed within the bearing housing 12. The bearing cap 32 and lip seal 34 also surround the drive shaft 18 at the outboard end to seal the bearing housing 12.

Figure 2:
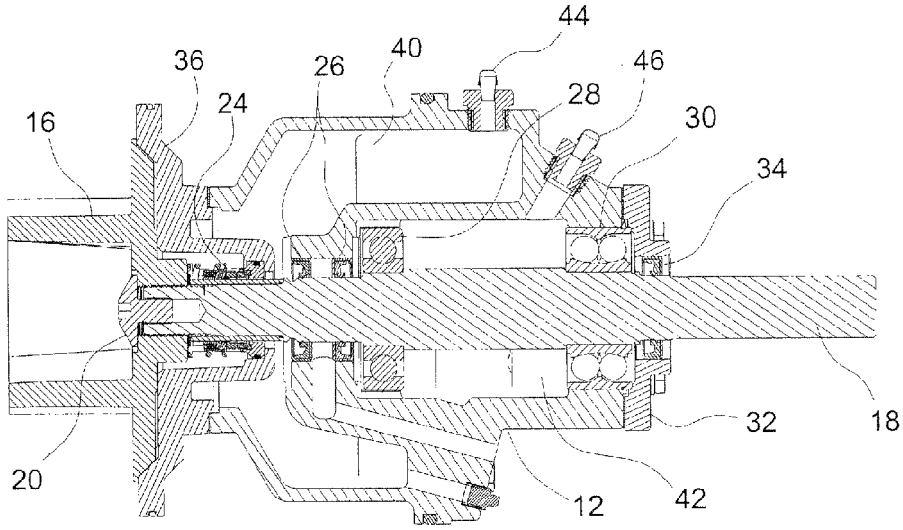
FIG. 2 (PRIOR ART)
FIG. 2 is a view in cross section of the rotating assembly of the pump shown in FIG. 1.

As may be viewed more specifically in FIG. 2, which illustrates just the rotating assembly 14 and seal plate 36 of a conventional, single-piece bearing housing 12, the bearing housing 12 is constructed with a mechanical seal oil chamber 40 and a bearing oil chamber 42 which is housed or nested within the mechanical seal oil chamber 40. The mechanical seal oil chamber 40 contains fluid lubricant for cooling and lubricating the mechanical seal 24. The lubricant is introduced into the mechanical seal oil chamber 40 through an inlet 44.

The bearing oil chamber 42 also contains fluid lubricant for cooling and lubricating the forward bearing 28 and the rear bearing 30. The bearing oil chamber 42 is filled through an inlet 46.

Figure 3:
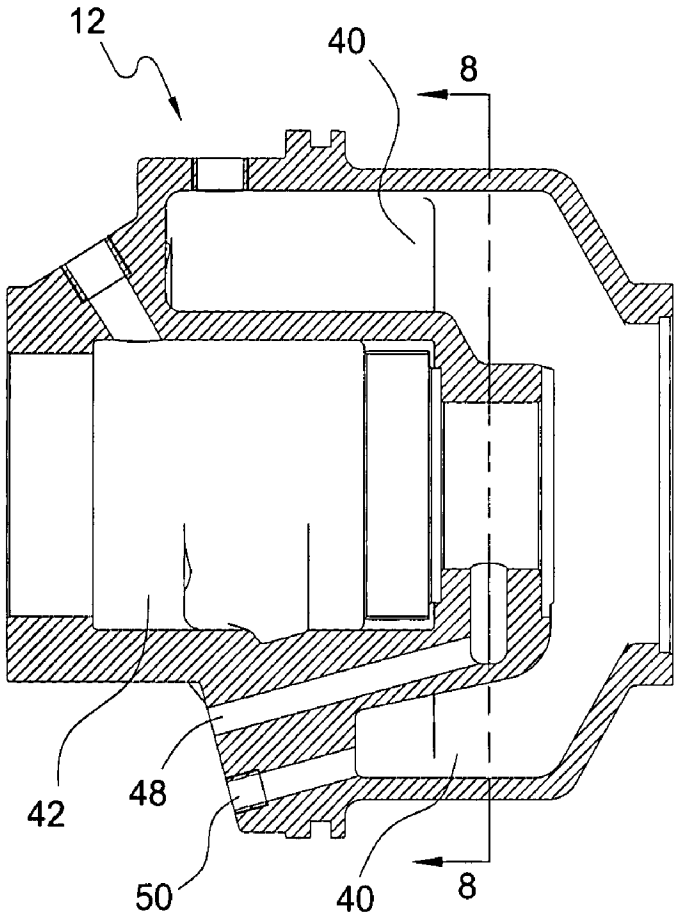
FIG 3. (PRIOR ART)
FIG. 3 is a view in cross section of the conventional one-piece bearing housing shown in FIG. 2, without the rotating elements, and shown rotated 180° in orientation from the view shown in FIG. 2.
Figure 8A:
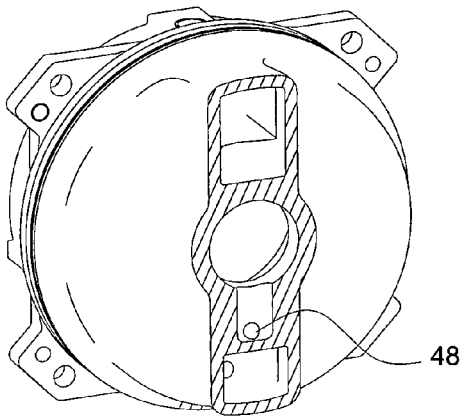
FIG. 8A (PRIOR ART)
FIG. 8A is a view in partial cross section of the one-piece bearing housing shown in FIG. 3 taken at line 8-8.
Figure 8B:
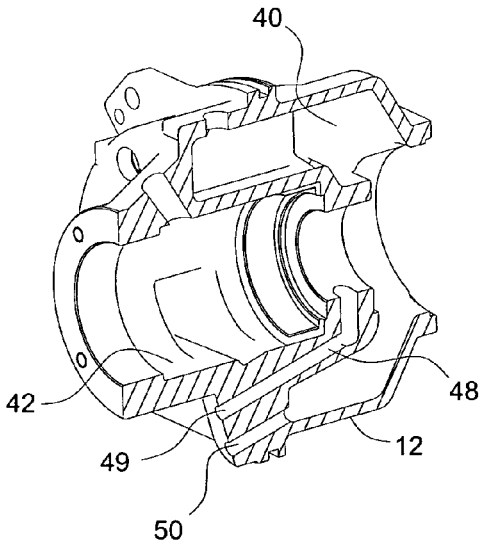
FIG. 8B (PRIOR ART)
FIG. 8B is a perspective view in cross section of the conventional one-piece bearing housing showing positioning of the atmospheric chamber drain port.
Figure 10:
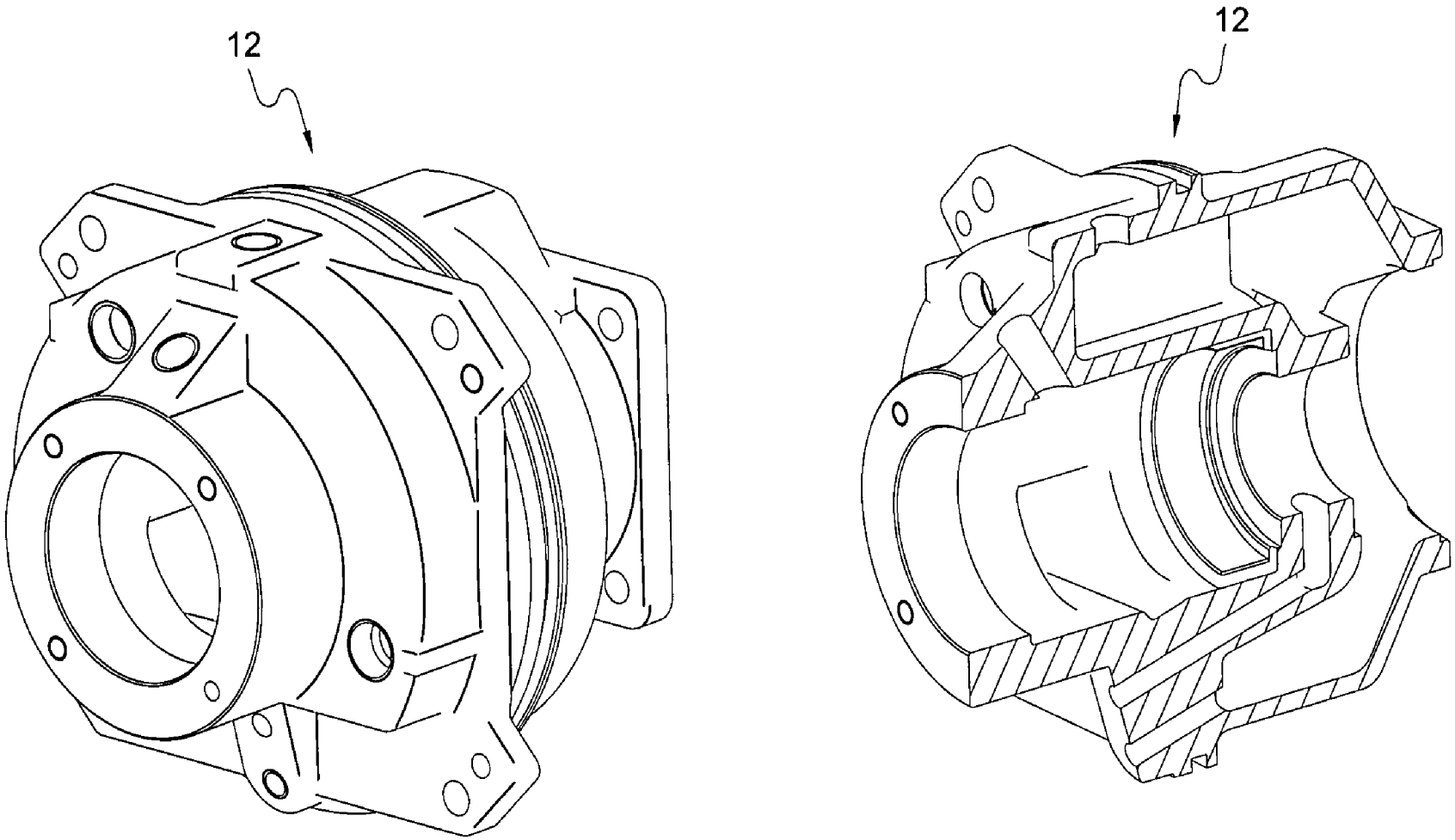
FIG. 10 (PRIOR ART)
FIG. 10 is a perspective view of the one-piece bearing housing shown in FIG. 8B, depicting both the outer housing and the cross sectional view of the bearing housing.
Figure 11:
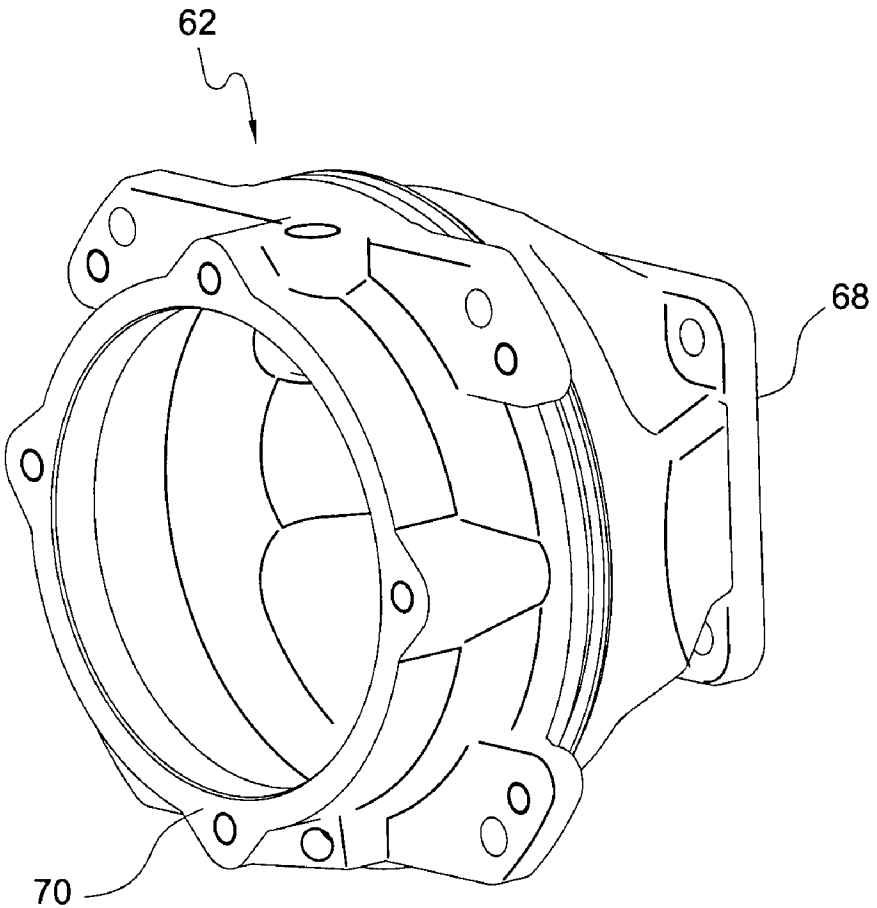
FIG. 11 is an exploded view of the two-piece bearing housing of the present invention.
Figure 11:
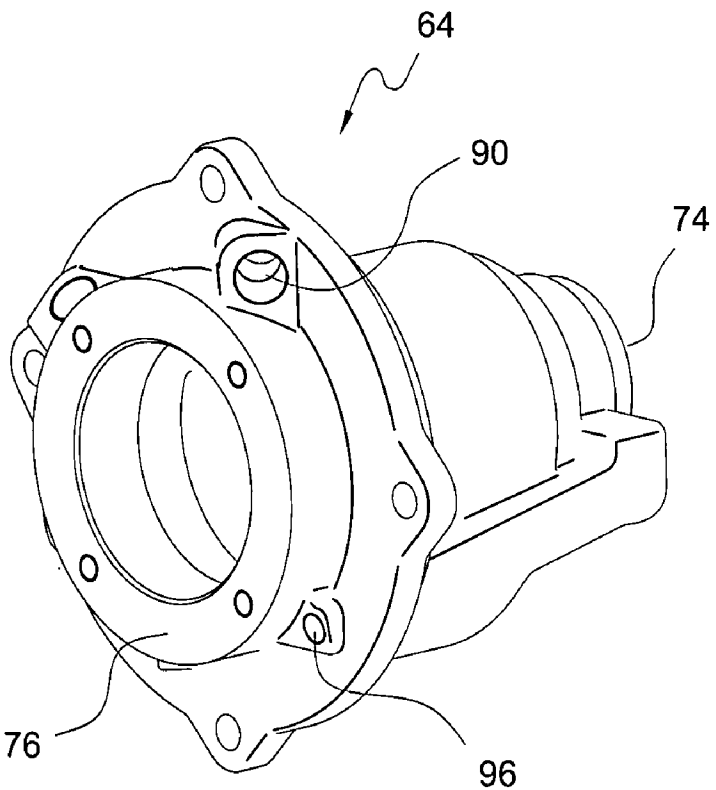

FIG. 3 illustrates further the construction of a single-piece bearing housing 12 of the prior art. Notably, the prior art bearing housing 12 illustrated in FIG. 3, when referenced against the same bearing housing 12 shown in FIGS. 1 and 2, is rotated 180° about an axis perpendicular to the central axis of the rotating assembly 14 corresponding to the drive shaft 18. FIG. 3 better depicts the construction of the conventional bearing housing 12 itself and provides a better illustration of the complexities of forming the single-piece bearing housing 12. Reference may also be made to FIGS. 8A and 8B and FIG. 10, which are perspective views of a single-piece bearing housing 12, to illustrate the configuration and manufacturing complexities.

In forming the single-piece bearing housing 12, a solid sand core is used which corresponds to the mechanical seal oil chamber and the bearing oil chamber. The solid sand core, in accordance with known casting techniques, is positioned within a mold the configuration of which corresponds with the outer shape of the bearing housing 12. The solid sand core must be positioned precisely in the mold for formation of the casting. Molten metal is then poured into the mold and about the solid sand core to produce the casting of the bearing housing 12, as illustrated in FIG. 3 and FIG. 8B.

When the metal has cooled and the casting has solidified or cured, the sand core is removed and the casting is further machined to provide the inlets 44, 46 into the mechanical seal oil chamber 40 and the bearing oil chamber 42, respectively. Atmospheric barrier drain port 48 and drain bore 50 are also machined to form drain conduits for the lip seals 26 (FIG. 1) and mechanical seal oil chamber 40, respectively.

As previously noted, the placement of the sand core in the mold for casting the conventional single-piece bearing housing is very complicated and requires precision that, if not achieved, can introduce errors into the casting process. Additionally, a gas is often produced when the molten metal contacts the sand core which results in porosities being formed in the casting. The porosities represent breaches in the wall of the bearing housing casting which can lead to failure of the bearing housing. Therefore, castings with too many or very severe porosities must be scrapped and the resulting cost of casting production is significantly increased.

The present invention is, therefore, directed to overcoming the numerous and heretofore insoluble problems encountered with producing conventional single-piece bearing housings. In accordance with the present invention, a two-piece bearing housing 60 is provided which overcomes these problems and represents a significant improvement in the pump casting art. The two-piece bearing housing of the present invention is illustrated in FIGS. 4, 5, 9A, 9B and 11. Structures of the present invention which are common to structures known in the prior art single-piece bearing housing 12 are denoted with the same reference numeral for clarity of comparison and description.

Figure 4:
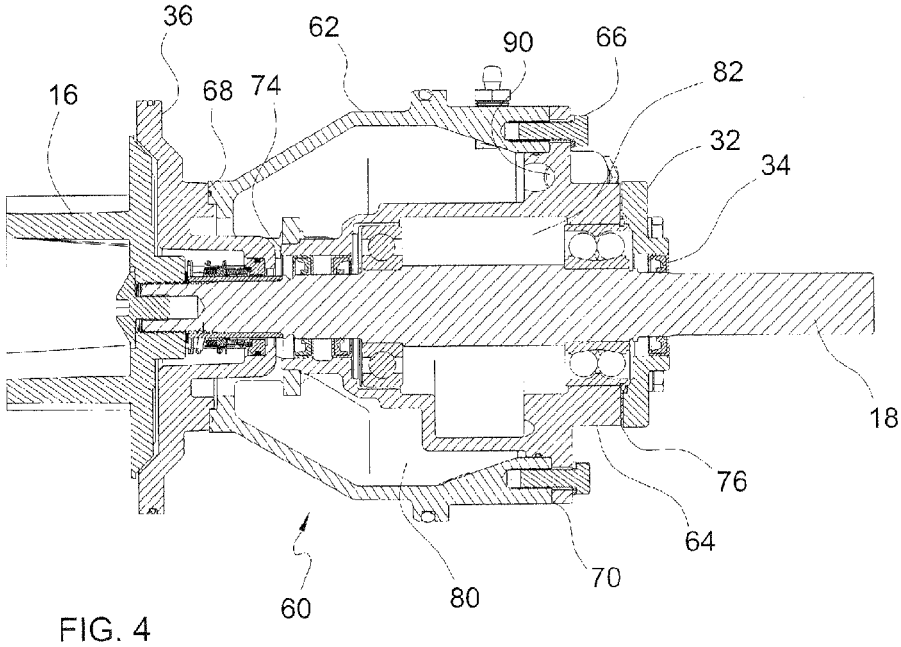
FIG. 4 is a view in cross section of the two-piece bearing housing of the present invention as part of the rotating assembly of a pump.
Figure 5:
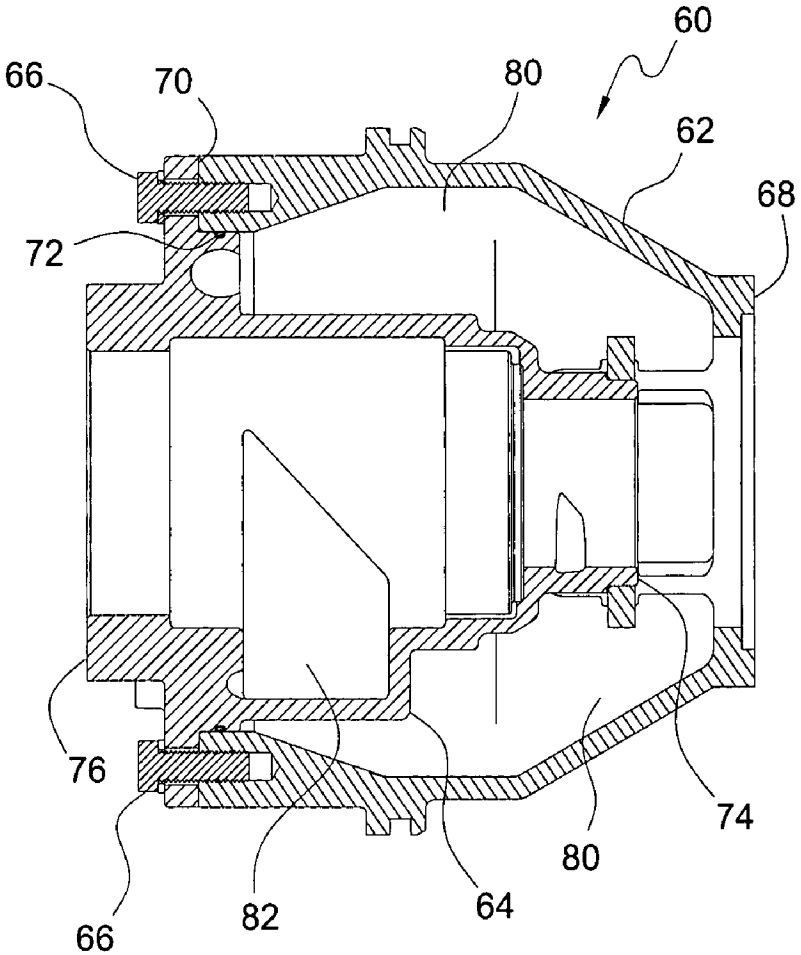
FIG. 5 is a view in cross section of the two-piece bearing housing shown in FIG. 4, without the rotating elements, and shown rotated 180° in orientation from the view shown in FIG. 4.

As depicted in FIGS. 4 and 5 (noting that the view in FIG. 5 is turned 180° from the view shown in FIG. 4), the bearing housing 60 of the present invention comprises two pieces, an outer housing 62 and an inner housing 64, which are separately formed through known sand core casting processes. The outer housing 62 has a first end 68 which is positioned to contact the seal plate 36 of the pump 10 and a second end 70 against which the inner housing 64 is securely positioned.

The outer housing 62 is secured to the inner housing 64 by any appropriate means. As depicted in FIG. 5, the outer housing 62 may be secured to the inner housing 64 by bolts positioned through the second end 70 of the outer housing 62. An o-ring 72 is positioned between the outer housing 62 and inner housing 64 to seal the two housings. The inner housing 64 has a first end 74 which is oriented for positioning adjacent the seal plate 36 and a second end 76 to which the bearing cap 32 is attached.

The inner housing 64 is nested within the outer housing 62 when the two pieces are joined. The outer housing 62 and inner housing 64 are concentrically positioned, having a common centerline which corresponds with the positioning of the drive shaft of the pump through the bearing housing 60. The outer housing 62 of the present invention provides the mechanical seal oil chamber 80 of the bearing housing 60 by formation of a space between the outer housing 62 and the inner housing 64. The inner housing 64 provides an inner space that defines the bearing oil chamber 82 of the bearing housing 60.

The separate formation of the outer housing 62 and inner housing 64 of the bearing housing 60 of the present invention provides several advantages heretofore unknown or unavailable to the conventional one-piece bearing housing construction. While the casting of the two pieces of the present invention still involves sand core casting processes, the two sand cores corresponding to the outer housing 62 and the inner housing 64 are easy to position in the mold for casting, and more precise castings can be achieved.

Additionally, the separate cores of the present invention eliminate any internal walls (i.e., the wall of the bearing oil chamber in a single-piece casting) thereby eliminating the difficulty encountered in releasing trapped gases formed in the single-piece construction that leads to undesirable porosities. As a result, the number of scrap castings is significantly reduced. This advantage provides not only a significant cost saving, but an environmental advantage in not having to dispose of discarded castings.

The respective oil chambers 80, 82 of the two-piece housing 60 have been designed to increase the oil capacity by as much as fifteen to twenty-five percent over conventional one-piece housings. Consequently, more cooling capacity is provided to the bearings and more lubrication capacity is provided to the mechanical shaft seal. The increased lubrication capacity increases the length of time the pump can remain in operation should the seals start to fail because of the increased lubrication that is available.

The larger openings and simplified cores of the casting process in the present invention enable sand to be more easily and completely removed, and the metal chips are more easily removed after machining. Machining and manufacturing costs are reduced as a result.

An even greater advantage in the present invention is realized in the ability to make the outer housing 62 casting and the inner housing 64 casting from different materials. That is, when especially corrosive and/or abrasive fluids are being processed by a pump, those portions of the pump that come in contact with the corrosive and/or abrasive fluid must be made of materials which are specially selected to resist corrosion or wear. Such materials may typically include stainless steel and high chrome alloys. Such materials are significantly more expensive due to their improved properties.

The mechanical seal oil chamber 80 is potentially subject to contact with the fluid being pumped and, therefore, it may be necessary or desirable to cast the outer housing 62 from an appropriate material that is capable of withstanding contact with the corrosive and/or abrasive fluid. However, the bearing oil chamber 82 is not subject to contact with the fluid being pumped and the inner housing 64 may, therefore, be made of less expensive material. The ability to cast the outer housing 62 separate from the inner housing 64, therefore, provides casting choices which reduce the manufacturing costs of the pump.

A further advantage of the present invention is realized in that the outer housing 62 of the present invention essentially is rendered a non-wear component given the ability to make the outer housing 62 of more corrosion-resistant material. A bearing failure in the present invention requires only a replacement of the less expensive inner housing 64 rather than replacement of the entire bearing housing 12 as is known in the conventional one-piece construction. This advantage provides not only a cost savings, but an environmental advantage.

Yet another significant advantage is realized in that the outer housing 62 alone can be replaced in the event that it becomes damaged, for example, in the course of normal operation due to abrasion and/or corrosion. The outer housing 62 can be replaced without the need to replace the inner bearing housing 64, and more significantly, the outer housing can be replaced without affecting the integrity of the bearings.

The ability to make the outer housing 62 of hard materials also has a significant advantage in that the tight machining tolerances (+/−0.0003) for the bearing housing 60 are required in the inner housing 64 or bearing oil chamber 82, not in the hard material outer housing 62. Machining bores with tight tolerances is much more difficult in hard materials than in soft materials, such as cast iron, which is what the inner housing 64 may typically be made of.

Figure 7:
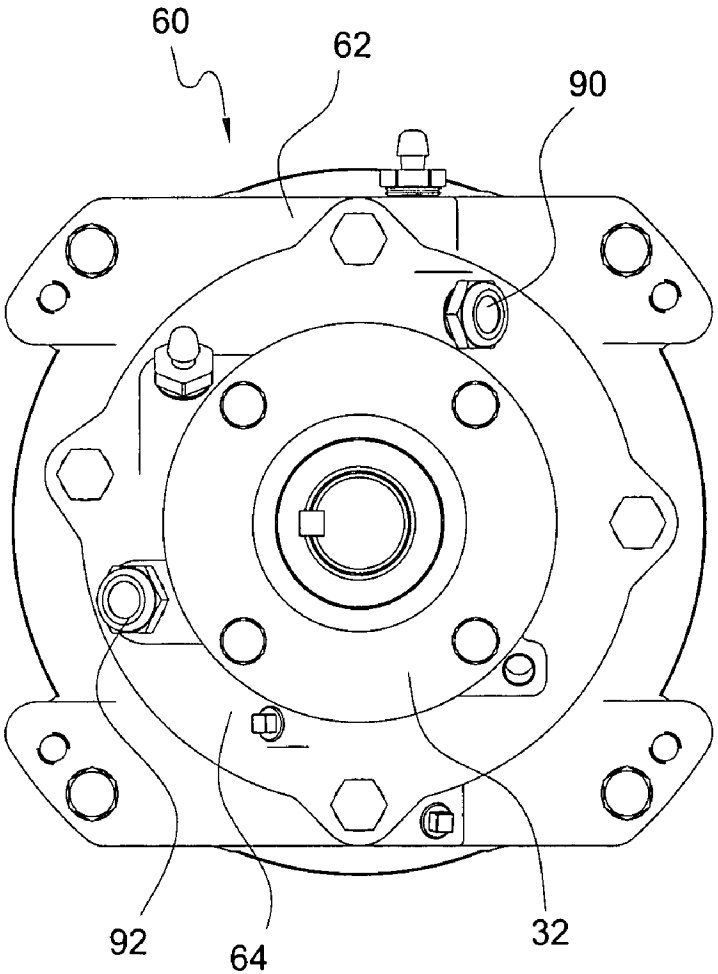
FIG. 7 is a view of the outboard end of a pump having a two-piece bearing housing and depicting the placement of view windows into the bearing chambers in the present invention.
Figure 6:
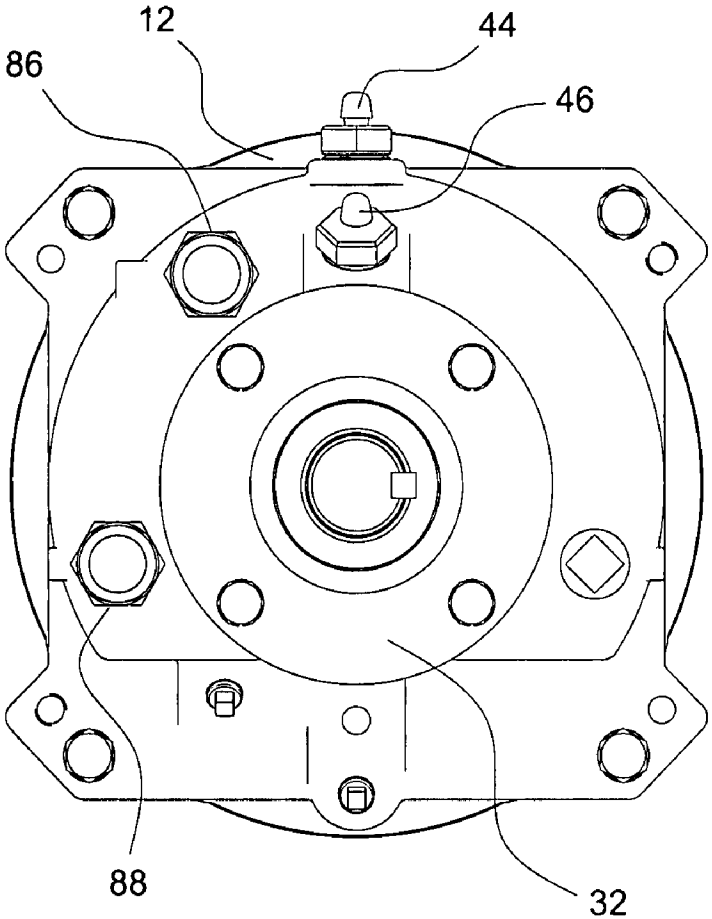
FIG. 6 (PRIOR ART)
FIG. 6 is a view of the outboard end of the pump shown in FIG. 1 having a one-piece bearing housing and depicting the conventional placement of view windows into the bearing chambers.

The two-piece bearing housing 60 of the present invention comprises an advantageous design element that is a further improvement over conventional one-piece bearing housings 12, as best illustrated in FIGS. 6 and 7. It can be seen from FIG. 6 that the conventional bearing housing 12 is provided with a window 86 for viewing the lubricant level in the mechanical seal oil chamber 40 and a window 88 for viewing the lubricant level in the bearing oil chamber 42 while the pump is in operation. Both windows 86, 88 of the conventional bearing housing are oriented along the axis of the pump and face the drive shaft couplings, which makes viewing the respective chambers 40, 42 very difficult when the drive shaft is rotating and the pump is running.

As illustrated in FIG. 7, the two-piece bearing housing 60 is structured with a window positioned through the inner housing 64 to enable viewing of the mechanical seal oil chamber 80 of the outer housing 62. A window 92 is also formed through the inner housing 64 to enable viewing of the bearing oil chamber 82 within the inner housing 64. Both windows 90, 92 are positioned at an angle to the centerline of the bearing housing 60, and thus the axis of the pump, which enables easier viewing of the respective oil chambers when the pump is in operation.

FIGS. 8A and 8B demonstrate a further disadvantage of known one-piece bearing housings. Specifically, FIG. 8A illustrates that in the conventional single-piece bearing housing 12, the atmospheric barrier drain port 48 is positioned parallel to the centerline of the pump and below the position of the drive shaft, which renders viewing of the outer opening 49, shown in FIG. 8B, of the drain port 48 very difficult when the pump is assembled and in operation. Leakage of fluid from the atmospheric barrier drain port 48 is an indication of bearing failure and is critical to proper monitoring and maintenance of the pump.

Figure 9A:
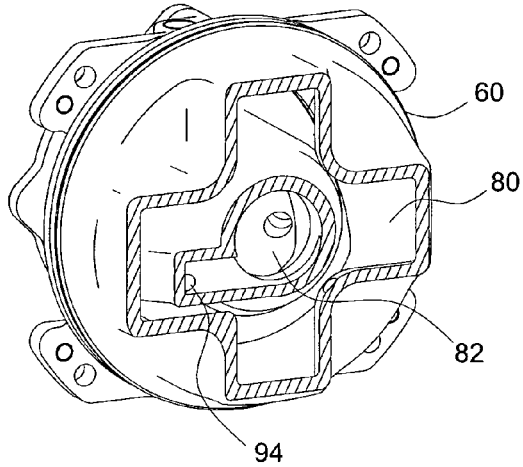
FIG. 9A is a view in partial cross section of the two-piece bearing housing of the present invention shown in FIG. 9B, taken at line A-A.
Figure 9B:
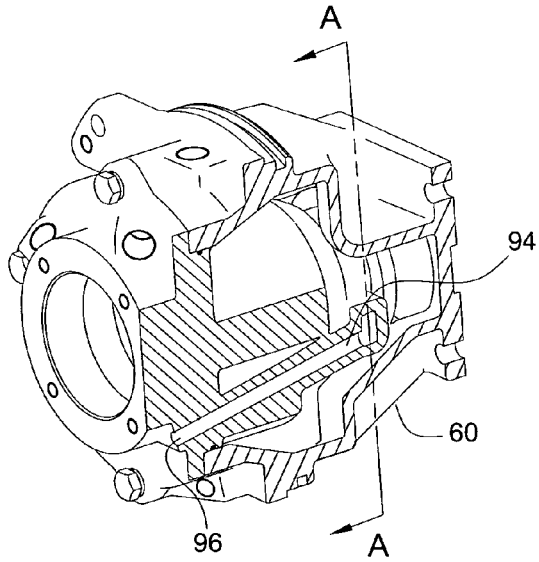
FIG. 9B is a perspective view in cross section of the bearing housing of the present invention depicting the arrangement and placement of the atmospheric chamber drain port.

FIGS. 9A and 9B illustrate that in the present invention, the atmospheric barrier drain port 94 is positioned at an angle to the centerline of the bearing housing 60 and is directed away from the drive shaft so that the exterior opening 96 is positioned laterally or to the side of the drive shaft making the drain port easily visible from the side of the pump when assembled and in operation. The ability to readily observe leakage through the atmospheric barrier drain port 94 enables timely replacement of the inner housing 64 or bearing housing. The angled position of the drain ports also facilitates easy access when changing the lubricants in the pump.

The two-piece bearing housing of the present invention is particularly suited for use in any centrifugal pump having seal and/or bearing requirements where the housing provided for the bearings and/or seals may employ multiple chambers that may also serve as lubricant-containing chambers, and where the housing is traditionally made in a single configuration. The two-piece bearing housing is adaptable to any number of pump applications. Hence, reference herein to specific details of the housing configuration is by way of example only and not by way of limitation.

What is claimed is:

1. A bearing housing for a centrifugal pump, comprising:

an outer housing forming a chamber which is structured to retain a fluid for lubricating or cooling the sealing elements of a centrifugal pump; and a separately formed inner housing sized for positioning within said chamber of said outer housing and being axially aligned with said outer housing, said inner housing forming a chamber for retaining a fluid for lubricating or cooling elements of the rotating assembly of the centrifugal pump, said inner housing having a window formed through said inner housing for observation of said chamber formed by said outer housing, the window being oriented at an angle to a defined centerline of the bearing housing, said inner housing further comprising a window formed through said inner housing oriented for observation of the chamber within the inner housing, said window being oriented at an angle to a defined centerline of said bearing housing and said inner housing having means for detachable securement to said outer housing; and an atmospheric barrier drain port extending from a point interior to said inner housing to a point external to said inner housing, said atmospheric barrier drain port being positioned at an angle to a defined centerline of said bearing housing and being positioned laterally to said defined centerline for positioning lateral to a drive shaft positioned through said bearing housing.

2. A centrifugal pump having a pump casing and a drive shaft positioned through said pump casing to support an impeller positioned within the pump casing, said centrifugal pump further comprising;

a bearing housing having an outer housing forming a chamber which is structured to retain a fluid for lubricating or cooling sealing elements of the centrifugal pump;

a separately formed inner housing sized for positioning within said chamber of said outer housing and being axially aligned with said outer housing, said inner housing forming a chamber for retaining a fluid for lubricating or cooling elements of the rotating assembly of the centrifugal pump, said inner housing having means for detachable securement to said outer housing and said inner housing having a window formed through said inner housing oriented for enabling observation into said chamber formed between said outer housing and said inner housing, said window being oriented at an angle to a centerline of said centrifugal pump defined by the axis of the drive shaft; and an atmospheric barrier drain port extending from interior to said inner housing to a point external to said inner housing, said atmospheric barrier drain port being positioned at an angle to a centerline of said centrifugal pump defined by the axis of the drive shaft and being positioned lateral to said drive shaft.

* * * * *